United States Patent [19]

Davies

[11] Patent Number: 4,993,439

[45] Date of Patent: Feb. 19, 1991

[54] CURLING DEVICE

[75] Inventor: Leslie O. Davies, No. 2 Croft House, Priory Court, Chirbury, Montgomery, Powys, United Kingdom

[73] Assignees: Leslie Owen Davies; Sepralash Limited, Santa Fe, both of N. Mex.

[21] Appl. No.: 525,348

[22] Filed: May 17, 1990

[30] Foreign Application Priority Data

Jul. 18, 1989 [GB] United Kingdom ..... 8916374.5

[51] Int. Cl.[5] ..... A45D 2/48

[52] U.S. Cl. ..... 132/217

[58] Field of Search ..... 132/216, 217

[56] References Cited

U.S. PATENT DOCUMENTS

| | | | |
|---|---|---|---|
| 2,159,912 | 5/1939 | Squire et al. | 132/217 |
| 2,391,047 | 12/1945 | Tuttle et al. | 132/217 |
| 2,411,519 | 11/1946 | Byron | 132/217 |
| 2,474,873 | 7/1949 | Tuttle et al. | 132/217 |
| 2,598,718 | 6/1952 | Palmer | 132/217 |
| 3,547,135 | 7/1968 | Roos | 132/216 |
| 4,791,944 | 12/1988 | Stein | 132/217 |

FOREIGN PATENT DOCUMENTS

| | | |
|---|---|---|
| 0081020 | 8/1981 | European Pat. Off. . |
| 0272034 | 8/1987 | European Pat. Off. . |
| 7628168 | 9/1976 | Fed. Rep. of Germany . |
| 52-154459 | 12/1977 | Japan . |
| 61-209607 | 9/1986 | Japan . |
| 62-137005 | 6/1987 | Japan . |
| 63-249504 | 10/1988 | Japan . |

*Primary Examiner*—John G. Weiss
*Assistant Examiner*—Michael Lynch
*Attorney, Agent, or Firm*—Poms, Smith, Lande & Rose

[57] ABSTRACT

A device for curling eyelashes including a first arcuate curling element having end regions and a middle region, and a second arcuate curling element having end regions and a middle region and adapted to co-operate with the first arcuate member to curl eyelashes; a first support member supports the first arcuate element at the middle region thereof and includes a guide portion; a second support member supports the second arcuate element at the middle region thereof and slidably engages the guide portion enabling sliding relative motion between the support members in the sense to move the first and second arcuate elements towards and away from one another; and a third member pivotally mounted to one of the support members and engageable with the other of the support members to urge the arcuate elements relatively towards one another.

14 Claims, 2 Drawing Sheets

FIG. 2.
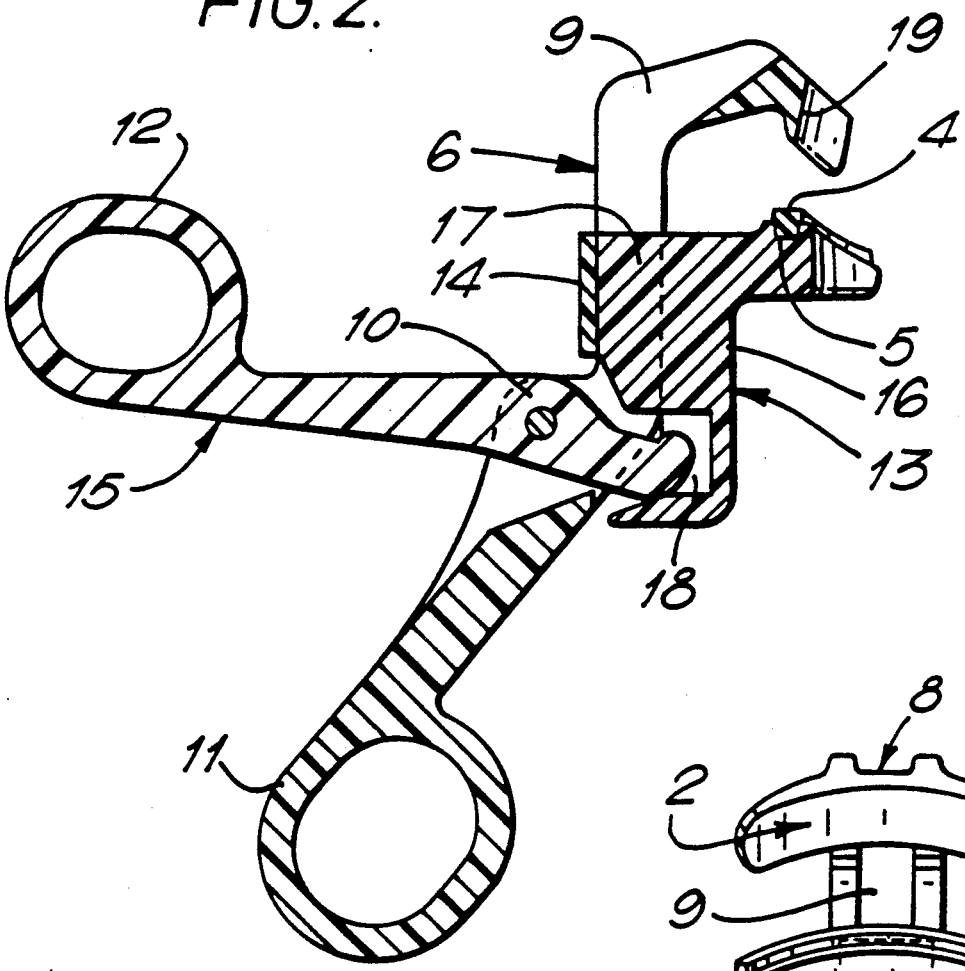
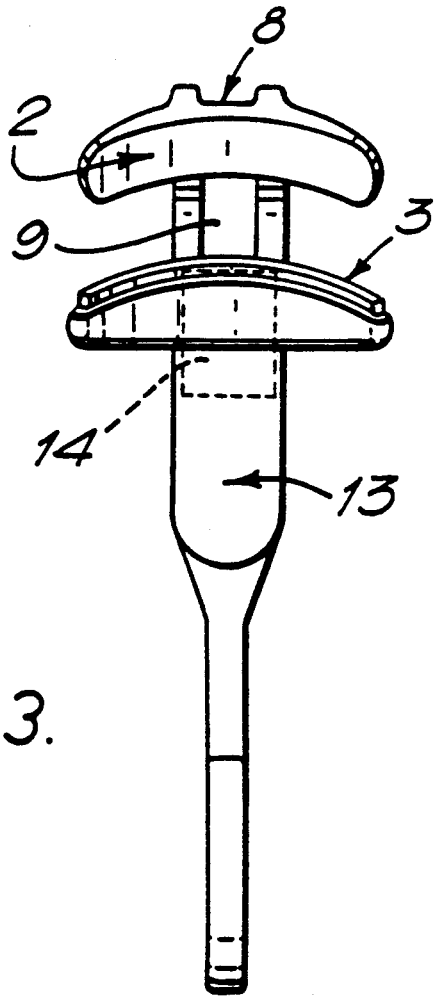
FIG. 3.

CURLING DEVICE

BACKGROUND OF THE INVENTION

The present invention relates to curling devices and in particular to eyelash curling devices.

SUMMARY OF THE INVENTION

According to one aspect of the present invention there is provided a device for curling eyelashes comprising: a first acruate curling element having end regions and a middle region; a second arcuate curling element having end regions and a middle region and adapted to co-operate with said first arcuate member to curl eyelashes; a first support member for supporting said first arcuate element at said middle region of said first arcuate element and having a portion providing guiding means; a second support member supporting said second arcuate element at said middle region of said second arcuate element and slidably engaging said guide means for enabling sliding relative motion between said support members in the sense to move said first and second arcuate elements towards and away from one another; and a third member pivotally mounted to one of said support members and engagable with the other of said support members to urge the arcuate elements relatively towards one another.

BRIEF DESCRIPTION OF DRAWINGS

For a better understanding of the present invention and as to how the same may be carried into effect reference will be made, by way of example, to the accompanying drawings in which:

FIG. 2 shows a cross-section of the device of FIG. 1; and

FIG. 3 shows the front view of the device of FIG. 1.

DESCRIPTION OF PREFERRED EMBODIMENT

Figure 1:
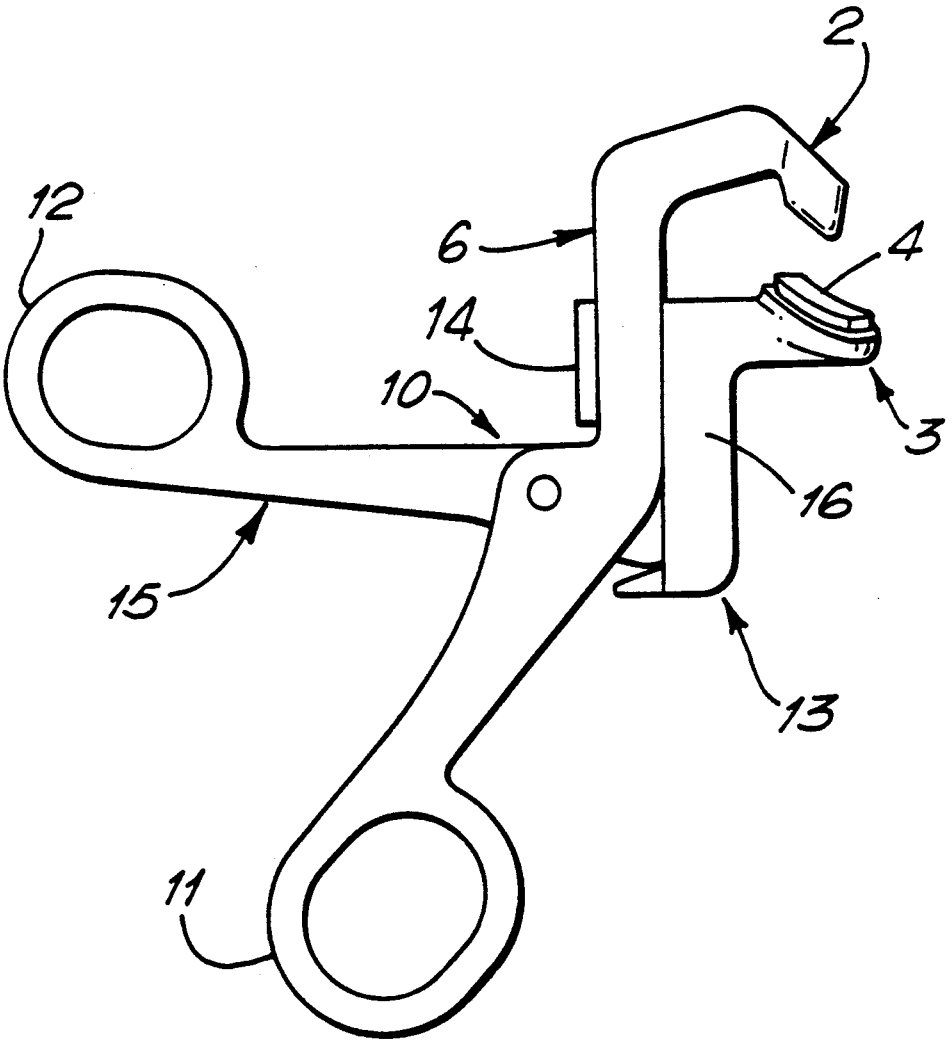
FIG. 1 shows a side view of an eyelashing curling device.

FIGS. 1, 2 and 3 show an eyelash curling device 1 having two lash curling elements 2 and 3 with shapes generally corresponding to the curve of the eye. The elements are adapted to cooperate together to curl eyelashes. The first of the elements has a portion 19 which tapers to form a curved curling edge which can press into a strip of flexible material 4 gripped in a recess 5 in the second element 3.

The edge is designed so as to be able to apply pressure to the lashes, without causing damage to the lashes or eye. To this end the edge is not sharp.

The flexible strip 4 of the second curling element 3 may be of any suitable material, such as rubber or a plastics foam and of suitable cross-sectional shape such as square. The recess 5 is curved to match the curve of the edge of element 2 and has cross-sectional dimensions such that the flexible strip 4 is releasably retained and follows substantially the same curve as that of the edge of element 2.

The curling elements are both supported in their middle regions only so as to leave their end regions free. The members are thus unlikely to interfere with the eye despite natural variation in shape and curvature of the eyes.

An elongate first member 6 integrally supports the curling element 2 at its middle region 8, leaving the end regions of the element 2 free. A slot 9 extends along a swan-neck portion of the member 6 from the element 2 to a pivotal area 10. The member then extends at an angle and terminates in a first of two "scissor-type" handles 11 and 12. A second member 13 integrally supports element 3 at its middle region, also leaving the end regions of element 3 free. Member 13 has a body portion 16 from which extends a rib 17 slidably received in the slot 9 of the first member 6. The rib 17 is retained in the slot 9 by a plate 14 with a width greater than that of slot 9. The plate 14 is attached to the second member, e.g. by glue, heat bonding or snap pin and socket fastening.

The body portion 16 has a recess 18 engaged by a free end of a third member 15 which is pivotably joined to the first member 6 at 10. The third member 15 terminates in the second "scissor-type" handle 12.

Preferably the members 6, 13 and 15 and plate 14 are moulded in hard plastics material, which may be transparent or translucent.

The operation of the device 1 will now be described. The eyelashes to be curled are placed between the two lash curling elements 2 and 3 spaced apart as shown in FIG. 1. The user can view the lashes in a mirror through the slot 9 when the elements 2 and 3 are spaced apart (FIG. 3) to check positioning. The two "scissor-type" handles 11 and 12 are then squeezed together. This causes the third member 15 to move the second member 13 along the slot 9. The two lash curling elements 2 and 3 are thus moved together so that the eyelashes are gripped between the two elements 2 and 3 and bent by the pressure of the edge of element 2 on the flexible strip 4. The pressure exerted by the two elements 2 can be controlled efficiently owing to the pivoting action of member 15, specifically to be pivoting of member 15 and its lever action on the sliding member 13. When the curling operation is complete, the elements 2 and 3 can be moved apart by moving the handles 11 and 12 away from one another.

The described eyelash curling device is only one embodiment of the invention. Variations are possible within the scope of the invention. For example the handles may be in the form of elongate members or be designed with indents suitable to receive fingures. The slot 9 may be replaced by two distinct regions, perhaps separated by a physical barrier, one region providing the viewing aperture which extends through the member and the second region slidably receiving member 13. The second region need not extend completely through the first member 6 and could, for example, be in the form of a guiding channel or recess. Thus, the member 6 in this region could have a U-shaped cross-section. The flexible strip 4 may simply be glued to the element 3, perhaps dispensing with the need for a recess 5, and may have various shapes in cross-section e.g. circular or semi-circular.

I claim:

1. A device for curling eyelashes comprising:

a first arcuate curling element having end regions and a middle region;

a second arcuate curling element having end regions and a middle region and adapted to co-operate with said first arcuate member to curl eyelashes;

a first support member for supporting said first arcuate element at said middle region of said first arcuate element and having a portion providing guiding means;

a second support member supporting said second arcuate element at said middle region of said second arcuate element and slidably engaging said guide means for enabling sliding relative motion between said support members in the sense to move said first and second arcuate elements towards and away from one another; and a third member pivotally mounted to one of said support members and engagable with the other of said support members to urge the arcuate elements relatively towards one another.

2. An eyelash curler as claimed in claim 1, wherein said end regions of said first and second curling arcuate elements are free.

3. An eyelash curler as claimed in claim 2, wherein the device is of moulded plastics material.

4. An eyelash curler as claimed in claim 2, wherein the device is of transparent moulded plastics material.

5. An eyelash curler as claimed in claim 2, wherein the third member and the said one support member have scissor-type handles.

6. An eyelash curler as claimed in claim 2. wherein the third member is pivotally mounted to the first support member and has a free end region, and the second support member has a slot into which the said free end region of the third member extends.

7. An eyelash curler as claimed in claim 1, wherein the third member and the said one support member have scissor-type handles.

8. An eyelash curler as claimed in claim 7, wherein the third member is pivotally mounted to the first support member and has a free end region, and the second support member has a slot into which the said free end region of the third member extends.

9. An eyelash curler as claimed in claim 1, wherein the third member is pivotally mounted to the first support member and has a free end region, and the second support member has a slot into which the said free end region of the third member extends.

10. An eyelash curler as claimed in claim 1, wherein the third member and said one support member have handle portions, and the other support member is slidable along a straight line path lying in a plane such that the arcuate elements are at one side of the plane and said handle portions of the third member and said one support member extend in directions away from and at the other side of the said plane.

11. An eyelash curler as claimed in claim 1, wherein a viewing aperture is defined through which one can view one's eyelashes in the spaced apart condition of the elements.

12. An eyelash curler as claimed in claim 11, wherein the first support member defines the viewing aperture.

13. An eyelash curler as claimed in claim 1, wherein the said guiding means comprises a channel in the first support member and in which said second support member is guided.

14. An eyelash curler as claimed in claim 13, wherein the first support member has a slot defining a viewing aperture and the said channel.

* * * * *